US006854955B2

(12) United States Patent
Shaffer et al.

(10) Patent No.: US 6,854,955 B2
(45) Date of Patent: Feb. 15, 2005

(54) INTERNAL LUBRICATION SCREW PUMP FOR HOLLOW SHAFT

(75) Inventors: Philip Conrad Shaffer, Golden, CO (US); Robert Grennan, Stillman Valley, IL (US)

(73) Assignee: Sundyne Corporation, Arvada, CO (US)

( * ) Notice: Subject to any disclaimer, the term of this patent is extended or adjusted under 35 U.S.C. 154(b) by 76 days.

(21) Appl. No.: 10/337,565

(22) Filed: Jan. 7, 2003

(65) Prior Publication Data

US 2004/0131464 A1 Jul. 8, 2004

(51) Int. Cl.[7] ..... F01D 5/100

(52) U.S. Cl. ..... 415/72; 415/112; 415/175; 184/6.16; 184/6.18

(58) Field of Search ..... 415/72–175; 189/6.16, 189/6.18

(56) References Cited

U.S. PATENT DOCUMENTS

| | | | | |
|---|---|---|---|---|
| 2,125,645 A | * | 8/1938 | Money | 184/6.18 |
| 3,493,168 A | * | 2/1970 | Valbjorn | 417/416 |
| 3,664,461 A | * | 5/1972 | Leffers et al. | 184/6.16 |
| 4,714,405 A | | 12/1987 | Schaefer et al. | |
| 5,827,042 A | | 10/1998 | Ramsay | |
| 5,984,627 A | | 11/1999 | Ramsay | |
| 6,210,103 B1 | | 4/2001 | Ramsay | |
| 6,234,490 B1 | | 5/2001 | Champlin | |
| 6,296,254 B1 | | 10/2001 | Young | |
| 6,450,785 B1 | * | 9/2002 | Dellby et al. | 415/111 |
| 6,716,001 B2 | * | 4/2004 | Kim | 417/363 |

OTHER PUBLICATIONS

A.B. Crease, Michael Neale and Associates, U.K., 7th International Conference On Fluid Sealing, Sep. 24th–26th, 1975, BHRA Fluid Engineering, Cranfield, Bedford, England.

* cited by examiner

*Primary Examiner*—Edward K. Look
*Assistant Examiner*—Igor Kershteyn
(74) *Attorney, Agent, or Firm*—Carlson, Gaskey & Olds, PC

(57) ABSTRACT

A rotary machine is provided, such as an electromechanical device, that includes a housing having a lubricating oil disposed within the housing. A shaft is rotatable about an axis relative to the housing. The shaft has a passage extending to an end portion of the shaft. A screw includes a body arranged coaxial to the shaft, and preferably affixed thereto. The screw includes helical blades extending outwardly from the body adjacent to a shroud. The shroud is arranged about the screw forming a gap between the blades and the shroud. Rotation of the shaft and screw pump the oil to the end portion of the shaft and into the passage from which the oil may be delivered to other machine components, such as the bearings. A flow straightener having radial fins may be arranged between the screw and the passage for controlling the flow of oil into the passage preventing a vortex.

17 Claims, 2 Drawing Sheets

INTERNAL LUBRICATION SCREW PUMP FOR HOLLOW SHAFT

BACKGROUND OF THE INVENTION

This invention relates to lubrication system for a rotary machine, and more particularly, the invention relates to an axial screw pump for providing supplemental lubrication and cooling to an electromechanical rotary machine.

Hollow shafts have been used in pumps and other rotary machines to permit oil to flow to areas in need of lubrication. The shaft and other components induce oil flow in the shaft passage as resulting from rotation of the shaft. However, lubrication circulation from this type of configuration is often inadequate for providing sufficient lubrication and cooling to shaft bearings.

Screw type arrangements have been employed with rotating shafts to provide a lubricated hydrodynamic seal. The seal includes a pair of mating portions with complementary helical grooves to provide a lubricating film between the portions so that the seal can withstand high rotational speeds. Although the seal provides a pumping action of oil there through, the screw arrangement is not sufficient to provide lubrication and cooling throughout the rotary machine. Other screw arrangements have been used as a pump for pumping fluid throughout the rotary machine. However, prior art screw pumps have not been used in combination with a hollow shaft to provide increased lubrication and cooling throughout the rotary machine.

Therefore, what is needed is a rotary machine having increased internal lubrication and cooling.

SUMMARY OF THE INVENTION AND ADVANTAGES

The present invention provides a rotary machine, such as an electromechanical device, including a housing having a lubricating oil disposed within the housing. A shaft is rotatable about an axis relative to the housing. The shaft has a passage extending to an end portion of the shaft. A screw includes a body arranged coaxial to the shaft, and preferably affixed thereto. The screw includes helical blades extending outwardly from the body adjacent to a shroud. The shroud is arranged about the screw forming a gap between the blades and the shroud. Rotation of the shaft and screw pump the oil to the end portion of the shaft and into the passage from which the oil may be delivered to other machine components, such as the bearings. A flow straightener having radial fins may be arranged between the screw and the passage for controlling the flow of oil into the passage preventing a vortex.

Accordingly, the above invention provides a rotary machine having increased internal lubrication and cooling.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENT

Figure 1:
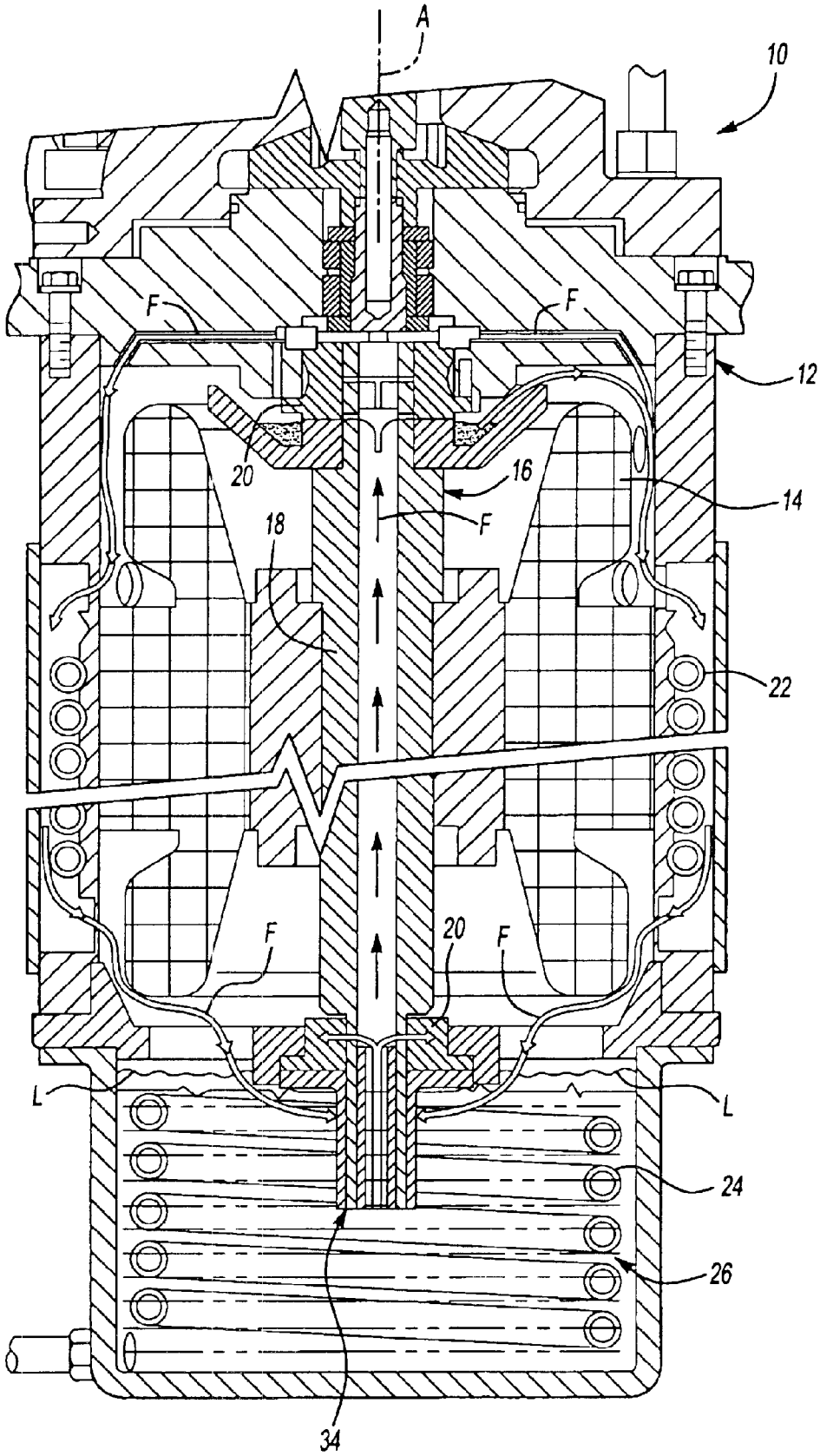
FIG. 1 is a cross-sectional view of one type of rotary machine.

A rotary machine 10, such as an electromechanical device, is shown in FIG. 1. The machine 10 includes a housing with a stator 14 disposed about a rotor 16, such as those found in known generators or motors. Of course, it should be understood that the machine 10 shown is only one type of rotary machine for which the present invention may be used.

The rotor 16 has a hollow shaft 18 that may be supported in the housing 12 by bearings 20. The shaft 18 is rotatable relative the housing 12 about an axis A. The machine 10 may rotate at significant speeds, and as a result, may produce large amounts of heat that may damage the machine components. To this end, cooling devices 22 and 24 may be employed to remove heat from the machine. However, in some applications the cooling devices may be insufficient for removing the necessary amount of heat to prevent failure of the machine 10.

Figure 2:
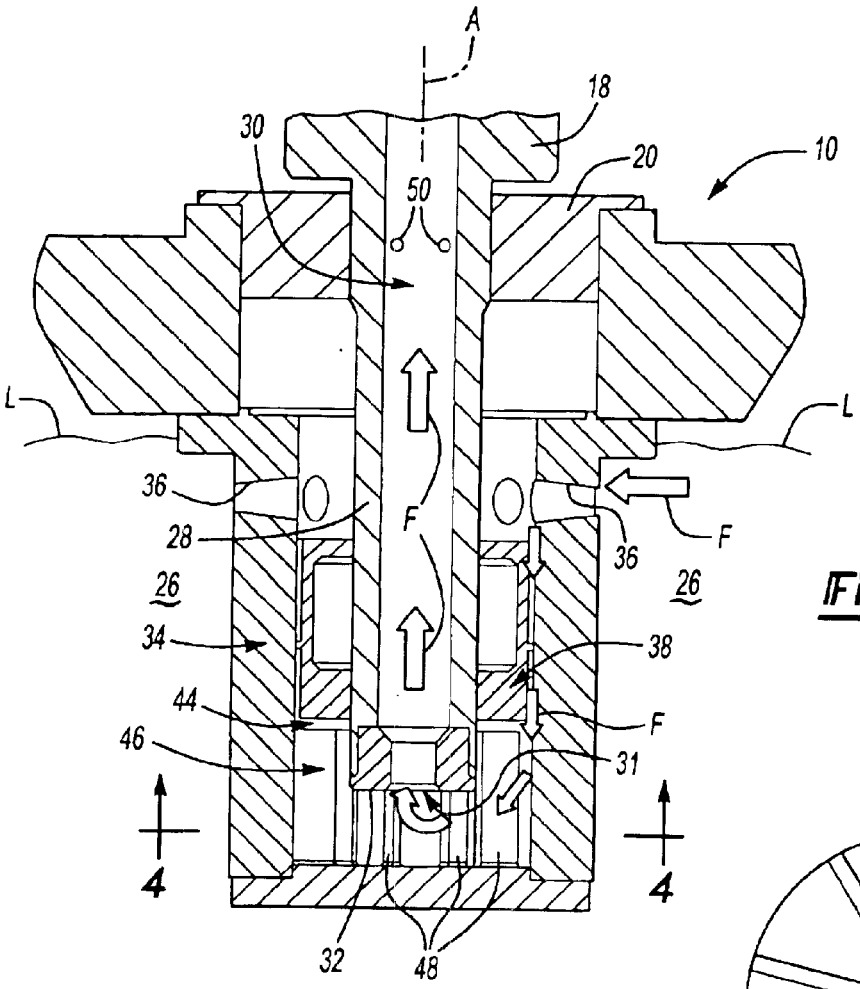
FIG. 2 is an enlarged view of a portion of the rotary machine shown in FIG. 1.

The housing 12 may define a sump 26 having a lubricating oil disposed within the housing 12 up to a level L. The oil is pumped throughout the machine 10 along lubrications paths f to components requiring lubrication and heat removal. The oil may be circulated and filtered in any know system as necessary. Referring to FIG. 2, the shaft 18 has a passage 30 extending to an end portion 28, preferably to a terminal end 32 defined by a shaft inlet 31. The shaft inlet 31 may be secured to the end of the shaft 28 to provide geometry to obtain desired flow characteristics for oil entering the passage 30.

A shroud 34 may be affixed to a portion of the housing 12 to enclose the end portion 28 of the shaft 18. Of course, the shroud may be integrally formed with the housing 12 or any other suitable component. The shroud includes fluid inlets 36 that are preferably submerged in the sump 26 so that the oil level L is higher that the inlets 36 to ensure a continuous supply of oil to the interior cavity of the shroud 34.

Figure 3:
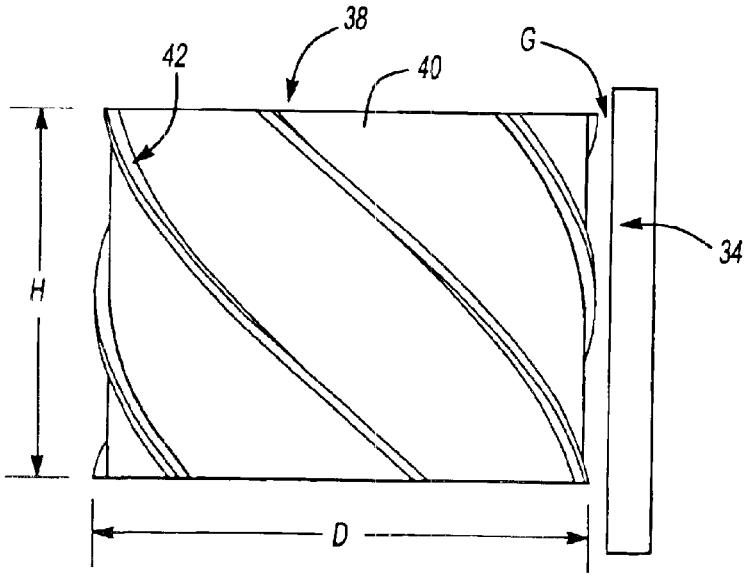
FIG. 3 is a side view of the screw shown in FIG. 2.

A screw 38 includes a body 40 arranged coaxial to the shaft 18, and preferably affixed thereto beneath the inlets 36. The screw 38 includes helical blades 42, best shown in FIG. 3, extending outwardly from the body 40 adjacent to a shroud 34. In one arrangement, the blade height may be 0.050 inch, the blade width may be 0.050 inch, and the blade angle may be 40°. The shroud 34 is arranged about the screw 38 forming a gap G between the blades 42 and the shroud 34, which may be 0.005 inch. In the arrangement described above, the diameter D of the screw 38 may be 2 inches and the height H may be 1.5 inches. Other dimensions for the screw 38 may be used to obtain desirable results. Rotation of the shaft 18 and screw 38 pump the oil axially to the end portion 28 of the shaft 18 and into the passage 30 from which the oil may be delivered to other machine components, such as the bearings 20 through holes 50.

Figure 4:
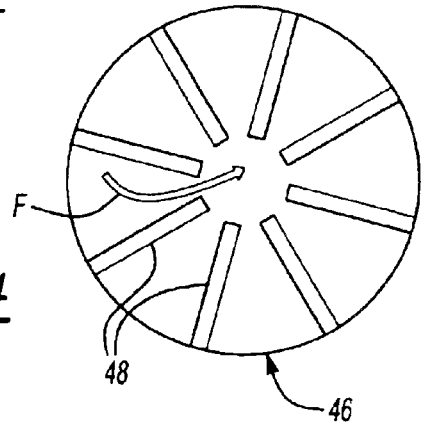
FIG. 4 is a cross-sectional view of the flow straightener taken along lines 4—4 in FIG. 2.

Referring to FIGS. 2 and 4, a flow straightener 46 having radial fins 48 may be arranged in the cavity 44 between the screw 38 and the passage 30 for controlling the flow of oil into the passage preventing a vortex, which would reduce the oil flow. The flow straightener 46 is arranged at the exit of the axial screw pump to ensure that the oil flows directly to the passage 30 without swirling about. The screw 38 pressurizes the cavity 44 to ensure that an adequate amount of oil is pumped through the shaft passage 30.

The invention has been described in an illustrative manner, and it is to be understood that the terminology that has been used is intended to be in the nature of words of description rather than of limitation. Obviously, many modifications and variations of the present invention are possible in light of the above teachings. It is, therefore, to be understood that within the scope of the appended claims the invention may be practiced otherwise than as specifically described.

What is claimed is:

1. A rotary machine comprising:

a housing having a lubricating oil disposed therein;

a shaft rotatable about an axis relative to said housing, said shaft having a passage extending to an end portion of said shaft;

a screw having a body arranged coaxial to and around said shaft and including at least one blade extending outwardly from said body; and a shroud arranged about said screw forming gap between said at least one blade and said shroud with rotation of said shaft and screw pumping said oil to said end portion of said shaft and into said passage.

2. The machine according to claim 1, wherein said shaft defines a rotor and wherein a stator is disposed within said housing about said rotor.

3. The machine according to claim 1, wherein bearings support said shaft for said rotation within said housing, and said shaft includes at least one hole in fluid communication with said passage proximate to said bearing for delivering oil to said bearings.

4. The machine according to claim 1, wherein said shroud encloses said end portion of said shaft, and said shroud including at least one fluid inlet permitting oil from a sump in said housing to flow to said screw.

5. The machine according to claim 4, wherein said sump includes an oil level with said oil level above said at least one fluid inlet submerging a portion of said shroud in said oil.

6. A rotary machine comprising:

a housing having a lubricating oil disposed therein;

a shaft rotatable about an axis relative to said housing, said shaft having a passage extending to an end portion of said shaft;

a screw having a body arranged coaxial to said shaft and including at least one blade extending outwardly from said body;

a shroud arranged about said screw forming gap between said at least one blade and said shroud with rotation of said shaft and screw pumping said oil to said end portion of said shaft and into said passage; and a flow straightener arranged between said screw and said passage for controlling the flow of oil into said passage preventing a vortex.

7. The machine according to claim 6, wherein flow straightener includes a plurality of fins extending radially inwardly from said shroud toward said end portion.

8. The machine according to claim 7, wherein said end portion includes a terminal end with said passage extending to said terminal end, said terminal end at least partially disposed within said flow straightener.

9. The machine according to claim 1, wherein said screw is affixed to said end portion.

10. A method of lubricating and cooling a rotary machine comprising the steps of:

a) drawing fluid from a sump;

b) pumping the fluid toward an end portion of a hollow shaft with a screw;

c) pressurizing a cavity surrounding the end portion using the screw; and d) pumping the fluid through the hollow shaft.

11. The method according to claim 10, wherein the screw is affixed to the end portion of the shaft.

12. The method according to claim 10, wherein the cavity is formed by a shroud surrounding the end portion.

13. The method according to claim 12, wherein the shroud is at least partially submerged in the sump.

14. A method of lubricating and cooling a rotary machine comprising the steps of:

a) drawing fluid from a sump;

b) pumping the fluid toward an end portion of a hollow shaft with a screw;

c) pressurizing a cavity surrounding the end portion using the screw; and d) pumping the fluid through the hollow shaft, wherein prior to step d) the fluid flow is straightened to prevent a vortex.

15. The machine according to claim 6, wherein said end portion includes a terminal end with said passage extending to said terminal end, said terminal end at least partially disposed within said flow straightener.

16. The machine according to claim 1, wherein said body is arranged around an exterior of said shaft.

17. The method according to claim 10, wherein said step c) includes pressurizing the cavity, the cavity is arranged around an exterior of the hollow shaft.

* * * * *